US005317933A

United States Patent [19]

Rometsch

[11] Patent Number: 5,317,933

[45] Date of Patent: Jun. 7, 1994

[54] STARTING DEVICE OF COMPACT CONSTRUCTION

[75] Inventor: Werner Rometsch, Gerlingen, Fed. Rep. of Germany

[73] Assignee: Robert Bosch GmbH, Stuttgart, Fed. Rep. of Germany

[21] Appl. No.: 915,701

[22] PCT Filed: Feb. 22, 1991

[86] PCT No.: PCT/DE91/00144

§ 371 Date: Jul. 22, 1992

§ 102(e) Date: Jul. 22, 1992

[87] PCT Pub. No.: WO91/14095

PCT Pub. Date: Sep. 19, 1991

[30] Foreign Application Priority Data

Mar. 3, 1990 [DE] Fed. Rep. of Germany ..... 4006795

[51] Int. Cl.[5] ..... F02N 11/02

[52] U.S. Cl. ..... 74/7 R; 74/7 E; 192/45

[58] Field of Search ..... 74/7 R, 7 A, 7 C, 7 E; 192/42, 45, 110 B; 290/386, 48

[56] References Cited

U.S. PATENT DOCUMENTS

| | | | |
|---|---|---|---|
| 1,039,685 | 10/1912 | Apple | 74/7 E |
| 3,584,713 | 6/1971 | Tani et al. | 192/45 X |
| 4,440,033 | 4/1984 | Kurihara et al. | 74/7 E X |
| 4,800,766 | 1/1989 | Isozumi et al. | 74/7 A X |
| 5,012,686 | 5/1991 | Morishita et al. | 74/7 A |

FOREIGN PATENT DOCUMENTS

| | | | |
|---|---|---|---|
| 1124304 | 2/1962 | Fed. Rep. of Germany | 74/7 R |
| 3042436 | 6/1982 | Fed. Rep. of Germany . | |
| 3225957 | 1/1984 | Fed. Rep. of Germany | 74/7 E |
| 3908870 | 9/1989 | Fed. Rep. of Germany . | |
| 2353721 | 12/1977 | France . | |
| 2628792 | 9/1989 | France . | |

OTHER PUBLICATIONS

Mark's, Standard Handbook for Mechanical Engineers, Ninth Edition, McGraw-Hill, N.Y., 1987, pp. 8-131 to 8-133.

*Primary Examiner*—Allan D. Herrmann
*Assistant Examiner*—David W. Laub
*Attorney, Agent, or Firm*—Michael J. Striker

[57] ABSTRACT

The starting device, particular a freely disengaging starting device, has an electric motor, the rotor of which drives a driven shaft which has a pinion for driving the gear ring of an internal combustion engine, in which the driven shaft end section carrying the pinion is supported in a face wall of the housing. For a compact structural form, in particular a short form, the driven shaft (6) is supported with its other end (23), via a first bearing (needle bearing 37) in a central aperture (166) of a free-wheel outer ring (35), the surface (164) of which is supported via a second bearing (deep groove ball bearing 38) on the housing (2) of the starting device (1). The associated end (25) of a rotor shaft (17) of the starter rotor (5) is supported via a third bearing (needle bearing 31) on the end section of the driven shaft (6) which lies in the interior of the housing (2).

15 Claims, 1 Drawing Sheet

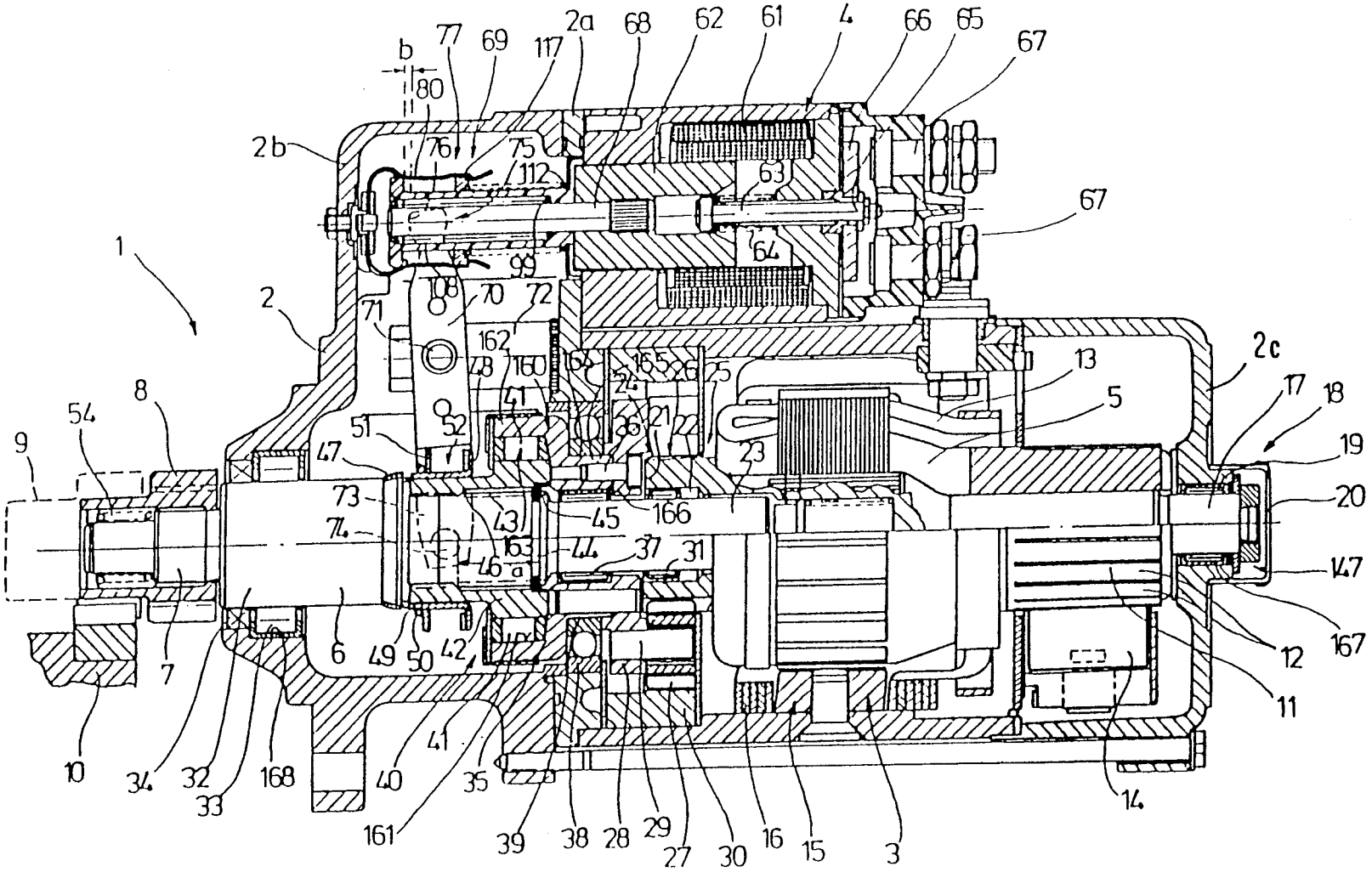
1
2
2a
2b
2c
3
4
5
6
7
8
9
10
11
12
13
14
15
16
17
18
19
20
23
24
25
26
27
28
29
30
31
32
33
34
35
37
38
39
40
41
42
43
45
47
49
50
51
52
54
61
62
63
64
65
66
67
68
69
70
71
72
73
74
75
76
77
80
99
108
112
117
147
160
161
162
163
165
166
167
168
b

STARTING DEVICE OF COMPACT CONSTRUCTION

BACKGROUND OF THE INVENTION

The invention relates to a starting device, in particular a freely disengaging starting device, with an electric motor, the rotor of which drives, via a free-wheeling clutch, a driven shaft which has a pinion for the drive of an internal combustion engine gear ring. In this starting device the end section of the driven shaft which carries the pinion is supported in a front face of the housing (DE-OS 39 08 870 ).

In motor vehicle technology, such starting devices are used for starting the vehicle engines. For the starting procedure, a pinion of the starting device moves into mesh with the engine gear ring. For the required axial movement of the pinion, a driven shaft which carries it is supported so as to be axially movable. When the starting procedure is complete, the pinion disengages from the gear ring, whereupon the driven shaft returns to its starting position. The axial movement of the driven shaft takes place preferably via a coarse pitch helix. A free-wheel device is further provided which effects a torque transmission in one direction of rotation and a disengagement in the other direction, so that after the engine has started, an "overrun" of the starting device is possible, resulting in a withdrawal of the pinion.

Due to the system for the axial displacement of the driven shaft and for the free-wheel arrangement and the required support points, the resulting physical length of such starting devices is relatively large, and becomes even larger, if they are configured as gear starters.

SUMMARY OF THE INVENTION

It is an object of the present invention to provide an improved starter device, which has an improved structure, facilitating construction of more compact starting devices, than those of the prior art.

In contrast, the invention in accordance with the main claim with the specified features has the advantage that a short and physically light form can be achieved. The driven shaft is supported via a first bearing in a central aperture of a free-wheel outer ring of the free-wheel device. The surface of the free-wheel ring is supported via a second bearing on the starting device housing. At the driven shaft end section which lies within the housing, the associated end of the starter motor rotor shaft is supported via a third bearing. This design in accordance with the invention results in the driven shaft being fixedly supported via the free-wheel outer ring inside the housing, with an end section of the driven shaft at the same time providing a bearing point for the appropriately facing end of the starter rotor. This design facilitates a compact and simple structure, since the number of bearing points which are directly supported on the starting device housing, is reduced.

According to a preferred embodiment example, the first bearing is a radial bearing, in particular designed as a rolling contact bearing. It may preferably be a needle bearing.

The second bearing—like the radial bearing— absorbs the radial forces, while, it also absorbs the axial forces, i.e. it is designed as an axial bearing, whereby axial fixing of the free-wheel outer ring takes place. In particular, it can be designed as a rolling contact bearing, preferably as a ball bearing, in particular as a deep groove ball bearing.

The third bearing again is a radial bearing, in particular a rolling contact bearing. here again, the rolling contact bearing may be designed as a needle bearing.

In accordance with a preferred embodiment example, the rotor shaft has an axial location hole in which the third bearing is arranged and into which the end of the driven shaft projects. The rotor shaft and the driven shaft thus run coaxially, whereby due to the engagement of the driven shaft in the location hole of the rotor shaft, "interleaving" results, which contributes to the small physical length of the starting device of the invention.

It is of advantage, if the other end section of the rotor shaft is supported in a fourth bearing, in particular a needle bearing, which is arranged in a first break-through in a rear face wall of the housing. The rotor shaft is thus always supported at its end sections.

A fifth bearing is provided, which is in particular designed as a cylindrical roller bearing. This is arranged in a second break-through in the front face wall of the housing, which is diametrically opposite the first break-through. The fifth bearing guides the driven shaft end section which emerges from the housing and on which the pinion previously mentioned is arranged.

In accordance with a specific embodiment example, the free-wheel outer ring is designed as a stepped bearing sleeve with two circular cross-sections of different sizes. The rolling bodies of the free-wheel device engage at the inner face of the larger diameter section of the bearing sleeve. The second bearing is arranged on the surface of the smaller diameter section of the bearing sleeve.

The central aperture of the free-wheel outer ring is limited by the internal wall of the smaller diameter section of the bearing sleeve. This results in an arrangement of the first bearing being accommodated in this central aperture at approximately the same height as the second bearing. Radial forces are thus diverted directly, i.e. over a short distance into the starting device housing. This design again contributes to a short and quietly running assembly.

In the design of the starting device as a gear starter, the free-wheel outer ring is connected to a pinion cage, against which planetary wheels are preferably supported which mesh with an internally toothed wheel, which is fixed to the housing, and with a sun wheel which is driven by the starter rotor. This design allows the drive between the d.c. motor, which has the starter rotor, and the driven shaft, to be realised in the smallest space. In particular, the sun wheel can be constructed on the surface of the rotor shaft.

For the axial displacement of the driven shaft, an internal ring is provided which acts in conjunction with the rolling bodies of the free-wheel device and which engages with the projections of the coarse pitch helix of the driven shaft.

BRIEF DESCRIPTION OF THE DRAWING

The objects, features and advantages of the present invention will now be illustrated in more detail by the following detailed description, reference being made to the accompanying drawing in which:

The sole FIGURE is a longitudinal cross-sectional view through a starting device according to the invention.

DETAILED DESCRIPTION OF A PREFERRED EMBODIMENT

The drawing shows a longitudinal section through a starting device 1. This has a housing 2, in which a d.c. motor 3 and a pull-in relay 4 are accommodated. The d.c. motor 3 has a rotor 5, which acts on a driven shaft 6, on an end section 7 of which a pinion 8 is torsionally rigidly arranged. The end section 7 is supported in the front face wall (*2b*) of the housing (2). For the starting operation of an internal combustion engine, not shown, the pinion 8 advances into the position 9 shown by a dashed line in the drawing, and in doing so shifts into mesh with a gear ring 10 of the internal combustion engine. The axial displacement of the pinion into the position 9 is caused by the pull-in relay 4. This will be dealt with in more detail later on.

The rotor 5 is provided with a commutator 11, to the segments 12 of which a rotor winding 13 is connected. The commutator 11 acts in conjunction with a carbon brush arrangement 14. Further, a stator 15 with a stator winding 16 is provided which shrouds the rotor 5, leaving a small airgap.

The rotor 5 has a rotor shaft 17 which at one end 18 is supported in a needle bearing 19 mounted in a throughgoing hole 167 in a rear housing wall 2C and covered by a housing cap 20. The other end of the rotor shaft 17 has a central locating bore 22 starting from its front face 21, into which one end 23 of the driven shaft 6 engages. This end of the rotor shaft 17 is supported on the end 23 of the driven shaft 6 via a needle bearing 31, which is arranged in the locating bore 22. The surface 24 of the end 25 of the rotor shaft 17 which has the locating bore 22 is configured as a sun wheel 26 which meshes with planetary wheels 27, which are arranged in a pinion cage 28 (the figure shows only one planetary wheel 27). The planetary wheels 27 are arranged on bearing pins 29, with needle rollers.

The planetary wheels 27 further mesh with an internally toothed annular gear ring 30 which is fixedly connected within the housing 2.

The end 23 of the driven shaft 6 is supported in the locating bore of the axial link 39 via a needle bearing 37. The free-wheel outer ring 35 is carried by a deep groove ball bearing 38, which is arranged on the axial link 39 and is itself supported in an interior wall (*2a*) of the housing 2 (fixed bearing). At the opposite end section 32 of the driven shaft 6, held by the housing 2, a cylindrical roller bearing 33 is provided in a throughgoing hole 168 in front face wall (*2b*), with a shaft seal 34 arranged in front of it, to the outside. The cylindrical roller bearing 33 supports the driven shaft 6 both in axial and radial directions.

The pinion cage 28 is axially coupled to a free-wheel outer ring 35 via screws 36. The free-wheel outer ring 35 is part of a free-wheel device 40, which is designed as a roller free-wheel. It has spring-loaded rollers 41, which act in conjunction with an inner ring 42 of the free-wheel device 40. The inner ring 42 is linked to the driven shaft 6 via a coarse pitch helix 43. The driven shaft 6 further has a groove 44, within which a retainer ring 45 is arranged. The retainer ring 45 forms a stop which acts in conjunction with a step 46 of the inner ring 42 during an axial displacement—yet to be described in more detail—of the driven shaft 6.

The free-wheel outer ring 35 is thus designed as a bearing sleeve 160 with two large circular cross-sections of different diameters. At the inner face 161 of the larger diameter section 162 of the bearing sleeve 160, rolling bodies 163, formed by the rollers 41 of the free-wheel device 40, engage. On the surface 164 of the smaller diameter section 165 of the bearing sleeve 160, the deep groove ball race 38 is arranged. Directly opposite this is the needle bearing 37, which is arranged in a central aperture 166 of the free-wheel outer ring 35. The driven shaft 6 has a holding ring 47 fixed to it which has a radial collar 48. Resting in a groove 49 of the holding ring 47 is a retainer ring 50 which supports a disc 51. Between the disc 51 and the radial collar 48, an annular channel 52 is thus formed.

At the end 7 of the driven shaft 6, the pinion 8 is supported torsionally rigid, but axially displaceable. It is spring-loaded by a compression spring 54. This is preloaded during displacement of the pinion 8 into the gear ring 10, a tooth-on-tooth position results.

The pull-in relay 4 has a fixed relay winding 61, which acts in conjunction with the armature 62. The armature 62 is supported axially slidable on an shaft 63 and is pushed into the position shown in the drawing by a return spring 64, which is designed as a compression spring, in the non-energized state of the pull-in relay 4. The shaft 63 has at its end section 65 a contact element 66, which can work in conjunction with electrical contacts 67.

The armature 62 is connected to a plunger 68 which projects into a housing space 69 of the housing 2. The plunger 68 acts in conjunction with a pull-in lever 70, designed as a double lever, which is pivoted in approximately its middle section by means of a transverse bolt 71. The transverse bolt 71 is held on an extension arm 72 on the housing. The lower end 73 of the pull-in lever 70 is provided with a projection 74 which engages in the annular channel 52. At the other end 75 of the pull-in lever 70, a carrier head 76 is arranged. With the displacement of the plunger 68, the pull-in lever 70 is carried along, whereby an axial displacement of the driven shaft 6 takes place. In the non-energized state of the pull-in relay 4 it must be ensured that the pinion 8 does not leave the position shown by the continuous lines in the drawing. A locking device 77, being formed essentially of a bow spring 80, a control sleeve 108, a ring 117, and springs 99 and 112, prevents the pinion 8 from moving unintentionally in the direction of the gear ring 10 of the internal combustion engine, since this could lead to damage of the components. This unintentional axial movement could occur, without the locking device 77, due to braking moments which, for example, arise through the bearings and a shaft seal, bringing the driven shaft 6 into the shift position, i.e. the return spring forces are smaller than the axial force components which arise on the coarse pitch helix.

It will be seen from the drawing that the carrier head 76 does not completely fill the gap between the one side of the ring 117 and a front face of the control collar 108; instead, there remains an free distance b.

The coarse helix 43 permits an axial displacement of the driven shaft 6 by the dimension a.

At the commutator end 18, the rotor shaft 17 is carried in a rotor bearing 147, which is designed as a needle bearing 19.

The starting device 1 in accordance with the invention operates as follows:

For a starting procedure of the internal combustion engine (not shown), the pull-in relay 4 is energized via a starter switch. This causes the armature 62 to move to the right (viewed from drawing), which causes the control sleeve 108 to move against the bow spring 80 such that the spring is radially spread out, thereby releasing the ring 117. A relative movement between the control sleeve 108 and the ring 117, taking up the free distance b, is possible because the latter is supported axially slidable on the control sleeve 108. When the bow spring 80 adopts its spread-out position, the free distance b is taken up, i.e. the left-hand side of the carrier head 76 is taken along by the control sleeve 108. The pull-in lever 70 performs a swivel movement in clockwise direction around the transverse bolt 71. During this action, the projection 74 shifts the driven shaft 6 in the direction of the gear ring 10, allowing the pinion 8 to shift into the teeth of the gear ring 10. The shifting forces ensure that the pinion 8 now enters fully into the gear ring 10, during which process due to the coarse helix 43, the driven shaft 6 moves out to the end position, so that—in the end result—position 9, shown in the figure by dashed lines, is adopted by the pinion 8. Since due to the pull-in movement of the relay 4, the contact element 66 enters into contact with the electrical connections 67, the d.c. motor 3 is energized, which causes the rotor 5 to rotate, whereby the pinion 8 is carried along by the reduction gear which is formed by the sun wheel 26, planet wheels 27, and the annular gear 30.

When the starting procedure is complete, the pull-in relay 4 will drop out. The drop-out movement is assisted by the return spring 64 and 112. In this action, the ring 117 pushes against the carrier head 76 of the pull-in lever 70, so that the pull-in lever 70 swivels anti-clockwise, whereby the pinion 8 is brought back into the position shown by a continuous line in the drawing. Since the internal combustion engine, now in operation, "overtakes" the rotation of the pinion 8 in the end stage of the starting procedure, the disengagement process is assisted by the coarse helix 43.

When the disengaged (resting) position has once more been assumed (drawing), the bow spring 80 is once again in the starting position, i.e. it secures the ring 117, so that the pull-in lever 70 is fixed in the position shown in the drawing. An unintentional axial displacement of the driven shaft 6 is thus prevented.

The invention proposes that the end section 32 of the driven shaft 6 is supported in the cylindrical roller bearing 33. The other end 23 of the driven shaft 6 is supported on the housing 2 of the starting device 1 via the needle bearing 37 and the freewheel outer ring 35 and the deep groove roller bearing 38, whereas the rotor shaft 17 is supported in the vicinity of the commutator 11 by the needle bearing 19. The rotor shaft end 25 embraces the end 23 of the driven shaft and is supported on it by means of the needle bearing 31.

It will be understood that each of the elements described above, or two or more together, may also find a useful application in other types of constructions differing from the types described above.

While the invention has been illustrated and described as embodied in a starting device with a compact construction, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed is new and desired to be protected by Letters Patent is set forth in the appended claims.

I claim:

1. A starting device for an internal combustion engine, said starting device comprising a housing (2) having an interior wall **(2*a*) in the interior of the housing (2) and a face wall (2*b*); an electric motor (3) having a rotor (5) mounted on a rotor shaft (17); a driven shaft (6) having an end section (7), another end section (23) and a pinion (8) mounted on said end section (7); a free-wheel outer ring (35) mounted inside the housing and having a central aperture (166); a first bearing (37), a second bearing (38) and a third bearing (31); and wherein said end section (7) of the driven shaft (6) having the pinion (8) is supported in the face wall (2*b*) of the housing (2) and said other end section (23) of the driven shaft (6) is supported via the first bearing (37) in the central aperture (166) of the free-wheel outer ring (35), and the first bearing (37) is located at said other end section (23) and, in turn, supported in the second bearing (38), said second bearing being mounted in the interior wall (2*a*) of the housing (2), and said other end section (23) of the driven shaft (6) inside the housing (2) is supported via the third bearing (31) in an associated end (25) of the rotor shaft (17)**.

2. Starting device in accordance with claim 1, wherein the first bearing is a radial bearing.

3. Starting device in accordance with claim 1, wherein the first bearing is a needle bearing (37).

4. Starting device in accordance with claim 1, wherein the second bearing is a deep groove ball bearing (38).

5. Starting device in accordance with claim 1, wherein the third bearing is a needle bearing (31).

6. Starting device in accordance with claim 1, wherein the rotor shaft (17) is provided with an axial locating bore (22), the third bearing is arranged in the axial locating bore (22) and the other end section (23) of the driven shaft (6) projects into the third bearing.

7. Starting device in accordance with claim 1, wherein an end section of the rotor shaft (17) remote from the associated end (25) is supported in a fourth bearing, said fourth bearing being arranged in a throughgoing hole (167) in a rear housing wall **(2*c*) of the housing (2)**.

8. Starting device in accordance with claim 1, further comprising a fifth bearing in a throughgoing hole (168) in the front face wall **(2*b*) of the housing (2), said fifth bearing supporting the end section (7) of the driven shaft (6) emerging from the housing wall (2*b*) and carrying the pinion (8)**.

9. Starting device in accordance with claim 1, further comprising a plurality of rolling bodies (163) of a free-wheel device (40) including the free-wheel outer ring (35) and wherein the free-wheel outer ring (35) comprises a stepped bearing sleeve (160) having a larger diameter circular cross-sectioned section (162) and a smaller diameter circular cross-sectioned section (165), and on an inner face (161) of said larger diameter section (162) the rolling bodies (163) of the free-wheel device (40) engage, and the second bearing is arranged on a surface (164) provided on said smaller diameter section (165).

10. Starting device in accordance with claim 9, wherein the central aperture (166) of the free-wheel outer ring (35) is bounded by the smaller diameter section (165) of the bearing sleeve (160).

11. Starting device in accordance with claim 1, wherein an annular gear (30) is fixed to the housing (2), the rotor shaft (17) is provided with a sun wheel (26) and a pinion cage (28) is coupled to the free-wheel outer ring (35) and said pinion cage supports planetary gears (27), said planetary gears meshing with the annular gear (30) fixed to the housing (2) and with the sun wheel (26), said sun wheel being driven by the starter rotor (5).

12. Starting device in accordance with claim 11, wherein the sun wheel (26) is configured on a surface (24) of the rotor shaft (17).

13. Starting device in accordance with claim 9, further comprising an inner ring (42) located in the vicinity of the rolling bodies (163), said inner ring (42) acting in conjuction with the rolling bodies (163) of the free-wheel device (40) and engaging with projections of a coarse helix (43) provided on the driven shaft (6).

14. Starting device in accordance with claim 7, wherein the fourth bearing is a needle bearing (19).

15. Starting device in accordance with claim 8, wherein the fifth bearing is a cylindrical roller bearing (33).

* * * * *